US007956552B2

(12) United States Patent
Champion et al.

(10) Patent No.: US 7,956,552 B2
(45) Date of Patent: Jun. 7, 2011

(54) APPARATUS, SYSTEM, AND METHOD FOR DEVICE GROUP IDENTIFICATION

(75) Inventors: David Frederick Champion, Durham, NC (US); Daniel Ernest Hurlimann, Austin, TX (US); Daniel Paul Kelaher, Holly Springs, NC (US); Timothy Andreas Meserth, Durham, NC (US); Michael Sven Miller, Raleigh, NC (US); Wallace G. Tuten, Georgetown, TX (US); David Thomas Windell, Raleigh, NC (US)

(73) Assignee: International Business Machiness Corporation, Armonk, NY (US)

( * ) Notice: Subject to any disclaimer, the term of this patent is extended or adjusted under 35 U.S.C. 154(b) by 537 days.

(21) Appl. No.: 12/050,809

(22) Filed: Mar. 18, 2008

(65) Prior Publication Data

US 2009/0237006 A1 Sep. 24, 2009

(51) Int. Cl.
*H05B 37/02* (2006.01)

(52) U.S. Cl. ..... 315/291; 315/155; 315/297; 315/312

(58) Field of Classification Search ..... 315/149–159, 315/291, 294, 297, 307, 312; 362/231, 234, 362/240, 253
See application file for complete search history.

(56) References Cited

U.S. PATENT DOCUMENTS

| | | | | |
|---|---|---|---|---|
| 5,877,863 | A * | 3/1999 | Ross et al. | 356/445 |
| 5,924,784 | A * | 7/1999 | Chliwnyj et al. | 362/234 |
| 6,300,923 | B1 | 10/2001 | Havel | |
| 6,888,322 | B2 | 5/2005 | Dowling et al. | |
| 6,897,624 | B2 | 5/2005 | Lys et al. | |
| 6,919,816 | B2 | 7/2005 | Dearborn et al. | |
| 6,924,780 | B1 | 8/2005 | Horst et al. | |
| 2004/0036424 | A1 * | 2/2004 | Hsieh | 315/291 |
| 2004/0218387 | A1 * | 11/2004 | Gerlach | 362/231 |
| 2006/0022214 | A1 * | 2/2006 | Morgan et al. | 257/99 |
| 2006/0066266 | A1 * | 3/2006 | Lim et al. | 315/291 |
| 2006/0097978 | A1 * | 5/2006 | Ng et al. | 345/102 |
| 2006/0158881 | A1 * | 7/2006 | Dowling | 362/231 |
| 2006/0190710 | A1 | 8/2006 | Rychlik | |
| 2006/0290710 | A1 | 12/2006 | Zwanenburg | |
| 2008/0094345 | A1 * | 4/2008 | Tseng et al. | 345/102 |
| 2010/0013414 | A1 * | 1/2010 | Johnson et al. | 315/297 |

OTHER PUBLICATIONS

Roa, V., Two LEDs Blend and Blink to Indicate Six States, Electronic Design (Journal), vol. 30, No. 16, p. 220, Aug. 5, 1982.

* cited by examiner

*Primary Examiner* — Douglas W Owens

*Assistant Examiner* — Tung X Le

(74) *Attorney, Agent, or Firm* — Kunzler Needham Massey & Thorpe

(57) ABSTRACT

An apparatus, system, and method are disclosed for identifying and differentiating among multiple groups of devices, comprising at least two LEDs, a controller, and a blending medium. The at least two LEDs emit a wavelength of light that is different from a wavelength of each other LED. The controller drives the at least two LEDs to each emit light at specified intensities in response to a color identifying value. The blending medium combines the light emitted by the at least two LEDs into an identifying color that identifies a group of devices.

18 Claims, 6 Drawing Sheets

APPARATUS, SYSTEM, AND METHOD FOR DEVICE GROUP IDENTIFICATION

BACKGROUND OF THE INVENTION

1. Field of the Invention

This invention relates to device identification and more particularly relates to identifying a group of devices.

2. Description of the Related Art

Data processing systems are employing increasing numbers of devices such as servers, routers, hard disk drives, and the like. The devices may be organized into one or more groups. Each group may share data, share communications, have a common control console, and be maintained together.

Each group is often designed to be scalable. Additional devices may be easily added to scalable group. Although a group may be organized logically, the group devices may be physically scattered throughout a data center. In addition, the data center may have a significant number of devices.

Administrators often need to physically identify which devices are in which groups. An administrator may attach an identifying tag to each device. Unfortunately, it is often difficult to keep identification tags current as the devices in a group scale. In addition the administrator might have difficulty keeping identifying tags current when devices are logically shifted from one group to another group.

SUMMARY OF THE INVENTION

From the foregoing discussion, there is a need for an apparatus, system, and method that identifies and differentiates among multiple groups of devices. Beneficially, such an apparatus, system, and method would use externally visible light emitting diodes (LEDs) and a blending medium.

The present invention has been developed in response to the present state of the art, and in particular, in response to the problems and needs in the art that have not yet been fully solved by currently available device group identification methods. Accordingly, the present invention has been developed to provide an apparatus, system, and method for identifying a group of devices that overcome many or all of the above-discussed shortcomings in the art.

The apparatus to identify a group of devices is provided with a plurality of modules configured to functionally execute the steps of driving LEDs, emitting light, and combining the light. These modules in the described embodiments include at least two LEDs, a controller, and a blending medium.

The at least two LEDs emit a wavelength of light that is different from a wavelength of each other LED. The controller drives the at least two LEDs to each emit light at specified intensities in response to a color identifying value. The blending medium combines the light emitted by the at least two LEDs into an identifying color that identifies a group of devices.

A system of the present invention is also presented to identify a group of devices. The system may be embodied in a device group identification system. In particular, the system, in one embodiment, includes a management network and a plurality of devices.

The plurality of devices communicate over the management network and are organized into at least two groups. Each device comprises at least two LEDs, a controller, and a blending medium.

The at least two LEDs emit a wavelength of light that is different from a wavelength of each other LED. The controller drives the at least two LEDs to each emit light at specified intensities in response to a color identifying value. The blending medium combines the light emitted by the at least two LEDs into an identifying color that identifies a group of devices.

A method of the present invention is also presented for identifying a group of devices. The method in the disclosed embodiments substantially includes the steps to carry out the functions presented above with respect to the operation of the described apparatus and system. In one embodiment, the method includes driving LEDs, emitting light, and combining the light.

At least two LEDs emit a wavelength of light that is different from a wavelength of each other LED. A controller drives the at least two LEDs to each emit light at specified intensities in response to a color identifying value. A blending medium combines the light emitted by the at least two LEDs into an identifying color that identifies a group of devices.

References throughout this specification to features, advantages, or similar language do not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention may be practiced without one or more of the specific features or advantages of a particular embodiment. In other instances, additional features and advantages may be recognized in certain embodiments that may not be present in all embodiments of the invention.

The present invention generates a unique color to identify devices. These features and advantages of the present invention will become more fully apparent from the following description and appended claims, or may be learned by the practice of the invention as set forth hereinafter.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION OF THE INVENTION

Many of the functional units described in this specification have been labeled as modules, in order to more particularly emphasize their implementation independence. Modules may include hardware circuits such as one or more processors with memory, Very Large Scale Integration (VLSI) circuits, gate arrays, programmable logic, and/or discrete components. The hardware circuits may perform hardwired logic functions, execute computer readable programs stored on tangible storage devices, and/or execute programmed functions. The computer readable programs may in combination with a computer system perform the functions of the invention.

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Furthermore, the described features, structures, or characteristics of the invention may be combined in any suitable manner in one or more embodiments. In the following description, numerous specific details are provided, such as examples of programming, software modules, user selections, network transactions, database queries, database structures, hardware modules, hardware circuits, hardware chips, etc., to provide a thorough understanding of embodiments of the invention. One skilled in the relevant art will recognize, however, that the invention may be practiced without one or more of the specific details, or with other methods, components, materials, and so forth. In other instances, well-known structures, materials, or operations are not shown or described in detail to avoid obscuring aspects of the invention.

Figure 1:
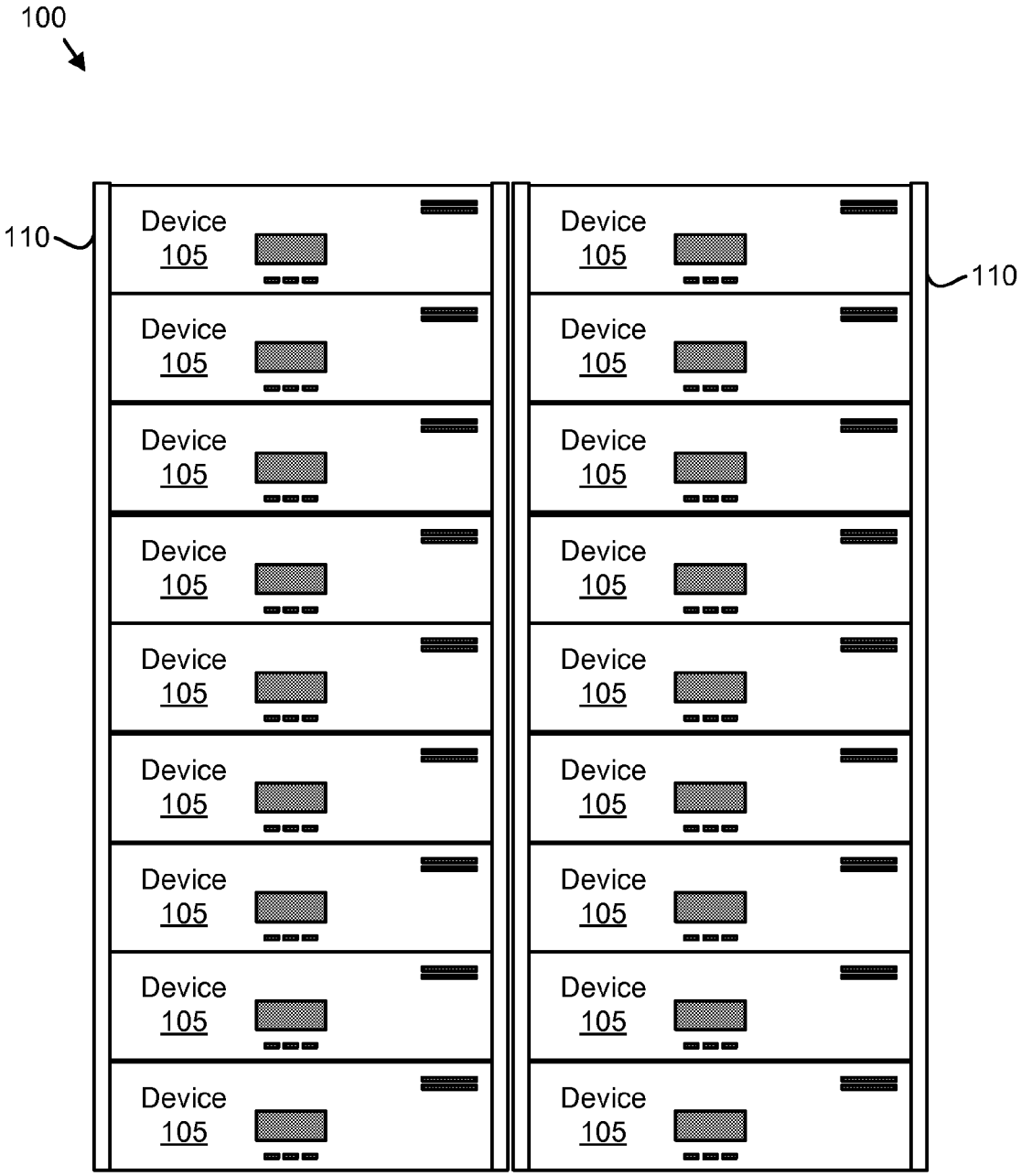
FIG. 1 is a drawing illustrating one embodiment of a data processing system in accordance with the present invention.

FIG. 1 is a schematic block diagram illustrating one embodiment of a data processing system 100. The system 100 includes one or more racks 110 of data processing devices 105. Each device 105 may be assigned to a logical group. An administrator may need to identify the devices 105 in a group. In the past, administrators have used tags, labels, and the like to identify the devices 105. However, tags and labels become impractical in data systems with large numbers of devices 105. In addition, the administrator may find it impractical and time-consuming to keep tags and labels current in a large data processing system 100.

For example, the administrator may logically assign one hundred (100) devices 105 from a first group to the second group. The devices 105 may be scattered throughout a data center. Manually identifying the new group assignment of the devices 105 is prohibitively time-consuming.

The present invention provides an apparatus, system, and method for identifying a group of devices. The device group identification apparatus disclosed herein generates a unique color to identify devices. Said apparatus comprises at least two light emitting diodes (LEDs), a controller, and a blending medium. The at least two LEDs emit a wavelength of light that is different from a wavelength of each other LED. The controller drives the at least two LEDs to each emit light at specified intensities in response to a color identifying value. The blending medium combines the light emitted by the at least two LEDs into an identifying color that identifies a group of devices.

The present invention identifies the group that each device 105 in the system 100 belongs to as will be described hereafter. Each data processing device 105 in the rack 110 comprises a group identification device of the present invention that enables identifying all the data processing devices 105 in the rack 110. One of skill in the art will readily recognize that the data processing system 100 could include any number of racks 110 and data processing devices 105, such as computers, printers, scanners, external storage devices, and the like.

Figure 2:
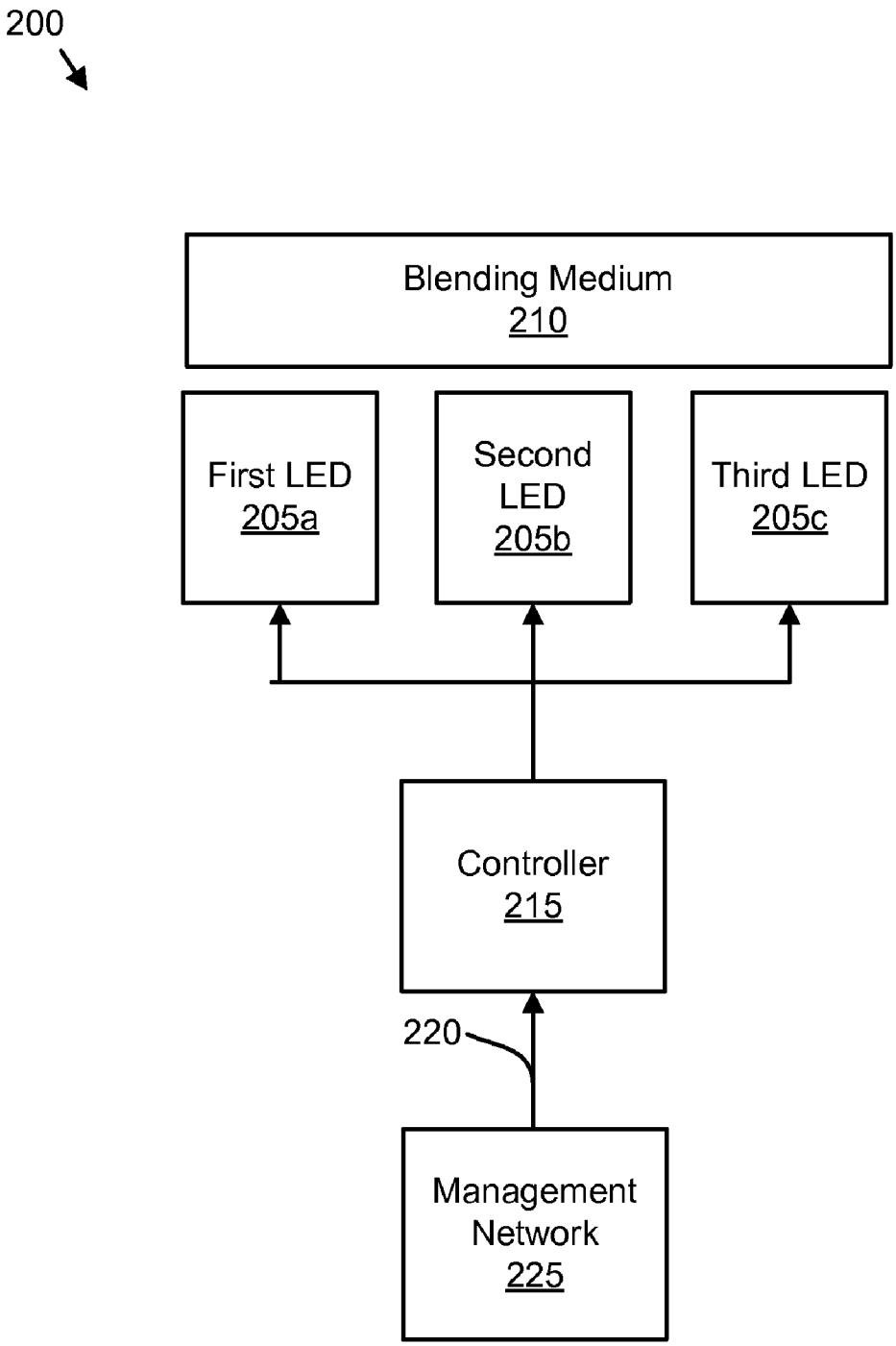
FIG. 2 is a schematic block diagram illustrating one embodiment of a group identification device of the present invention.

FIG. 2 is a schematic block diagram illustrating one embodiment of a group identification device 200 of the present invention. The group identification device 200 includes one or more light emitting diodes (LEDs) 205, a blending medium 210, a controller 215, and a management network 225. The description of the group identification device 200 refers to elements of FIG. 1, like numbers referring to like elements.

Although three LEDs 205*a-c* are shown, any number of LEDs 205 greater than one may be employed. In one embodiment, the LEDs 205 include a lens. Alternatively, the one or more LEDs 205 do not have a lens. In a certain embodiment, the LEDs 205 are configured as Organic Light Emitting Diodes (OLED). In addition, the LEDs 205 may be Polymer Light Emitting Diodes (PLED). One of skill in the art will recognize that the invention may be practiced with additional diode-based light emitters and other light emitting devices.

Each LED 205*a*, 205*b*, or 205*c* emits a wavelength within the visible spectrum of light which lies in the range between four hundred nanometers (400 nm) and seven hundred nanometers (700 nm). The wavelengths below four hundred nanometers (400 nm), including ultraviolet (UV) wavelengths, X-rays, and Gamma rays, and above seven hundred nanometers (700 nm), including infrared (IR) wavelengths and radio waves, cannot be perceived by the human eye. The visible spectrum of light may include the spectral range of the following colors: violet, indigo, blue, green, yellow, orange, and red.

In one embodiment, a first LED 205*a* emits a green wavelength, a second LED 205*b* emits a blue wavelength, and a third LED 205*c* emits a red wavelength. By driving each LED 205 to emit light at a specified intensity, the device 200 may create the visible spectrum of colors. For example, the first and third LEDs 205*a,c* may emit green and red light respectively maximum intensity, while the second LED 205*b* emits no blue light. As a result, the device 200 may emit yellow line.

In an alternate embodiment, the first LED 205*a* emits a cyan wavelength, the second LED 205*b* emits a magenta wavelength, and the third LED 205*c* emits a green wavelength. In a certain embodiment, the first LED 205*a* emits a violet wavelength, the second LED 205*b* emits an orange wavelength, and the third LED 205*c* emits a green wavelength. The LEDs 205 may emit wavelengths selected from red, green, blue, cyan, magenta, purple, orange, red-orange, red-violet, yellow-orange, yellow-green, blue-violet, and blue-green.

The number of LEDs in the present invention cannot be less than two. However, any number of LEDs to a far greater than two may be employed.

The controller 215 receives the color identifying value over a communication channel 220 from the management network 225. An administrator may direct the management network 225 to identify devices 105 as part of specified groups. For example, the administrator may use the management network 225 to assign first devices 105 to a primary server group and assign second devices 105 to a secondary server group. The administrator may further use the management network 225 to assign a unique color identifying value to each group. The management network 225 communicates the color identifying values over the communication channel to a controller 215 for each device 105.

The controller 215 drives the LEDs 205 to each emit light at specified intensities in response to the color identifying value to the LEDs 205*a*, 205*b*, and 205*c* on the respective group of data processing devices 105. The corresponding LEDs 205*a*, 205*b*, and 205*c* emit wavelengths of light at specified intensities depending in response to the color identifying value. Each LED 205*a*, 205*b*, or 205*c* emits a wavelength of light that is different from a wavelength of each other LED 205*a*, 205*b*, or 205*c*.

The blending medium 210 combines the wavelengths emitted by the LEDs 205*a*, 205*b*, and 205*c* into an identifying color that identifies the group of devices. As a result, the distinctive color of the light allows the administrator to identify the whole group and each device in it.

When there are multiple groups of devices in a concurrent physical environment, the communication channel may be shared among the group of devices 105 through a management network. Each group will be differentiated from the others by a distinctive color. For instance, devices in Group 1 may light in red, those in Group 2—in green, those in Group 3—in blue, and the like.

Additionally, since the LEDs 205 can be set at any wavelength, color-vision impaired users can set the LEDs 205 at such a wavelength of light that is discernible to them. As most color-vision impairments only affect vision in a portion of the visible light spectrum, distinct wavelengths will help them identify a group of devices, as well as differentiate among multiple groups.

Figure 3A:
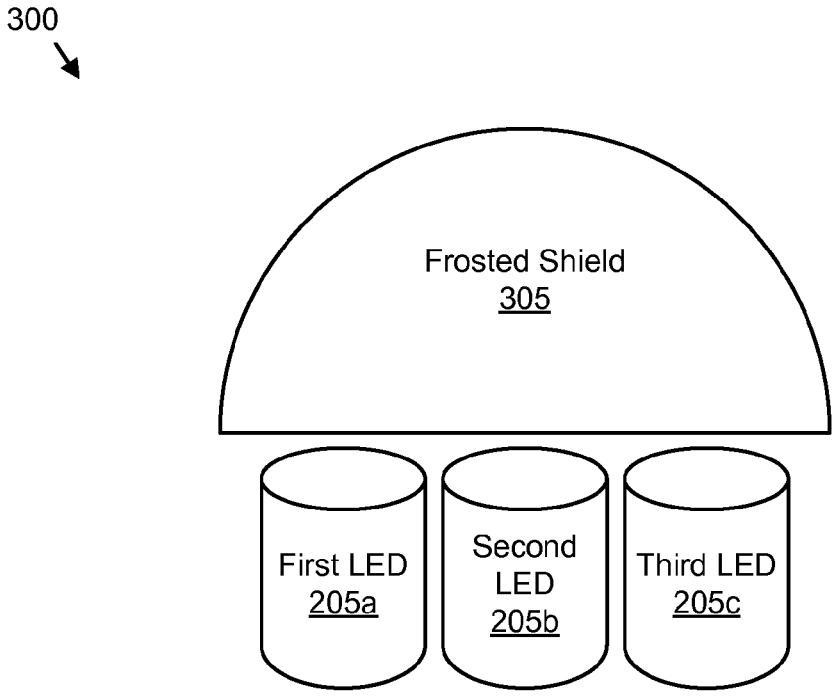
FIGS. 3A and 3B are schematic block diagrams illustrating one embodiment of a blending medium of the present invention.
Figure 3B:
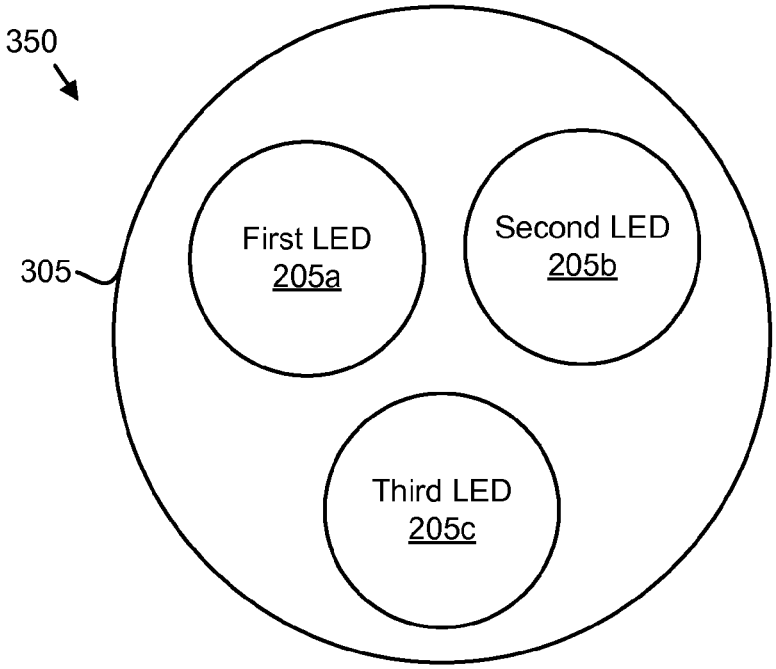

FIGS. 3A and 3B are schematic block diagrams illustrating one embodiment of a blending medium 300 and 350 of the present invention comprising a frosted shield 305. The description of blending medium 300 and 350 refers to elements of FIGS. 1 and 2, like numbers referring to like elements. FIG. 3A depicts a front view of the embodiment, while FIG. 3B shows its top view. In the depicted embodiments, the blending medium 300, 350 is a frosted shield. The frosted shield 305 may be plastic. The plastic maybe polypropylene. Alternatively, the blending medium 300, 350 may be glass.

Figure 4:
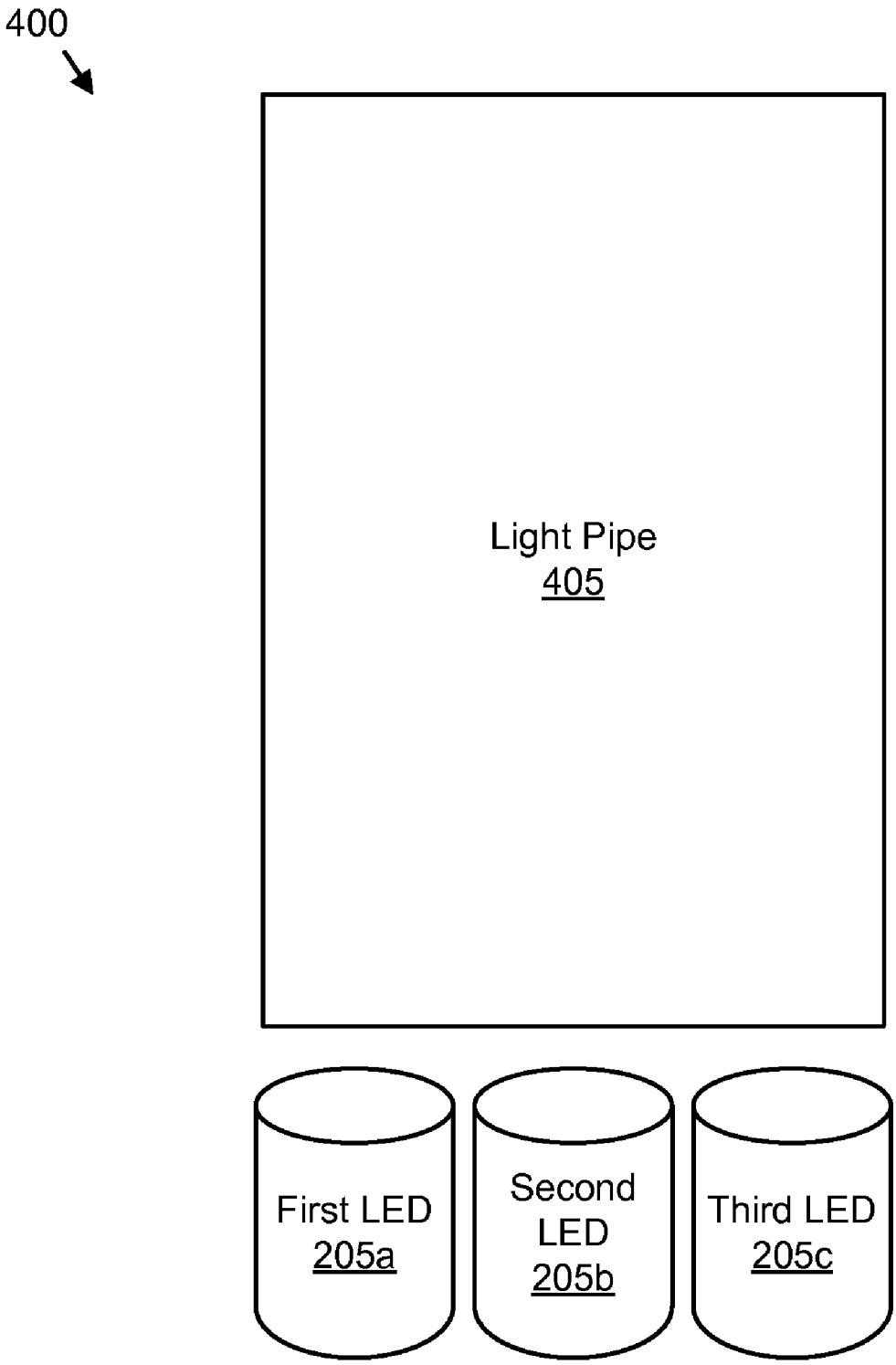
FIG. 4 is a schematic block diagram illustrating another embodiment of a blending medium of the present invention.

FIG. 4 is a schematic block diagram illustrating another embodiment of a blending medium 400 of the present invention comprising a light pipe 405. The description of blending medium 400 refers to elements of FIGS. 1-3, like numbers referring to like elements. In one embodiment, the light pipe 405 comprises one or more optic fibers. Alternatively, the light pipe 405 may comprise a translucent material. The light pipe 405 combines the light from each LED 205*a*, 205*b*, or 205*c* and transports the light to a visible portion of the device 105.

Figure 5:
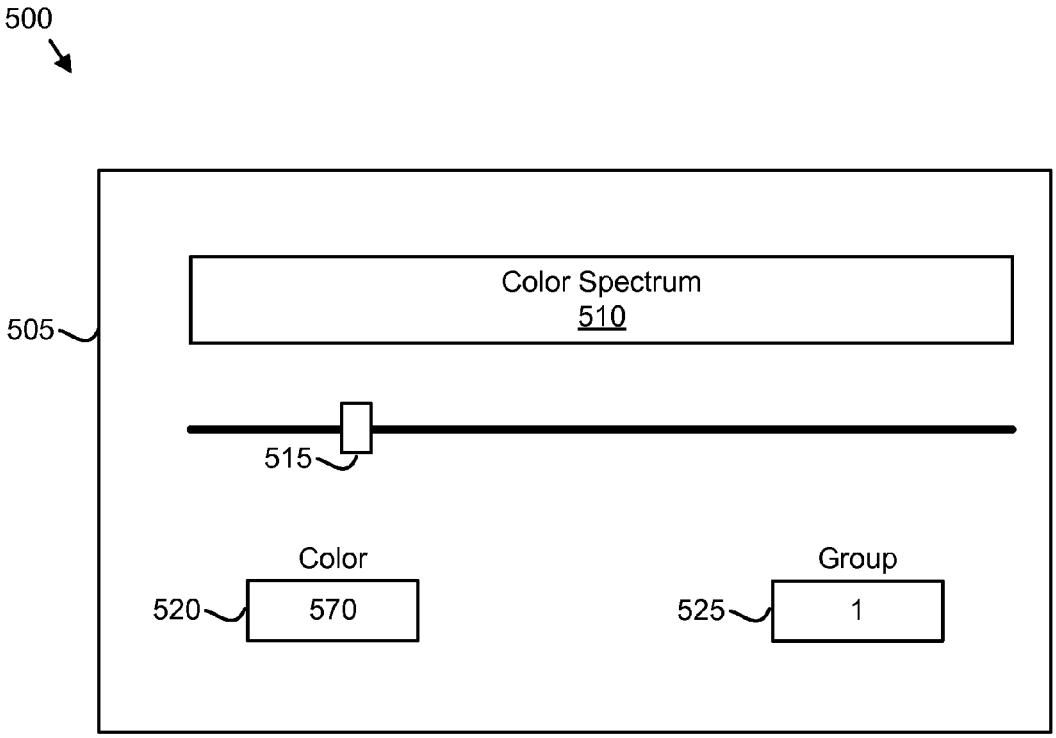
FIG. 5 is a schematic block diagram illustrating one embodiment of a color selection interface of the present invention.

FIG. 5 is a schematic block diagram illustrating one embodiment of a color selection interface 500 of the present invention. The color selection interface 500 receives the color identifying value and a group selection for the group of devices 105. In this particular embodiment, the color selection interface 500 is a Graphical User Interface (GUI) 505 for customization of LED wavelength. GUI 505 comprises a color spectrum scale 510, a slider control 515, a color value field 520, and a group number field 525. All these components are interconnected and serve to associate a specific wavelength of light with a rack 110 of data processing devices 105.

The administrator specifies the color identifying value either by adjusting the slider control 515 on the color spectrum scale 510 or entering a numerical value of the wavelength in the color value field 520. Both controls are tied together so that if either is manipulated, new values would be displayed in the other. This feature also allows the administrator to preview the color selection before assigning it to a group of devices.

Next, the administrator enters a number in the group number field 525 which can be used as a name for that group of devices 105. This feature provides a naming structure for each group in an inventory tracking system or data center management software. Every time either a group number or color value is specified in the respective field, the associated data will automatically appear in the other field, thus preventing the administrator from assigning the same wavelength to 2 separate groups of devices 105 while editing or updating an existing group or adding a new one.

In an alternate embodiment, the group number field 525 receives a name for each group of devices 105. For example, the administrator may name a first group of devices 105 as "server group 1." The administrator may enter the group name using the keypad and/or keyboard as is well known to those of skill in the art.

Such a graphical selection interface can be provided through the scaled system or clusters OS, external management software applications such as IBM Director, or onboard management applications such as RSA, RSA2 or the Advanced Management Module in the case of Blades.

Another embodiment of a color selection interface of the present invention is a command line interface for customization of LED wavelength. It allows the administrator to enter numerical values only. The administrator may use Equation 1 for selecting the color identifying value, where $N_{Gr}$ is the number of the group to be assigned a color identifying value and $T_{Gr}$ is the total number of groups in the data processing system 100. Each color identifying value selected through this equation will be easily discernable from each other color identifying value.

$$\text{Color}=N_{Gr}*(300/T_{Gr})+400 \qquad \text{Equation 1}$$

For example, if there are 5 groups in the data processing system 100, the first one will be assigned 1*(300/5)+400=460 nm (blue), the second one—2*(300/5)+400=520 nm (green), the third one—3*(300/5)+400=580 nm (yellow), the fourth one—4*(300/5)+400=640 nm (orange), and the last one—5*(300/5)+400=700 nm (red).

While the GUI 505 need not display associated colors, the GUI 505 may be made available independent of which operating system is loaded and without having to load additional software on the system by providing an option through system BIOS or other native software.

Figure 6:
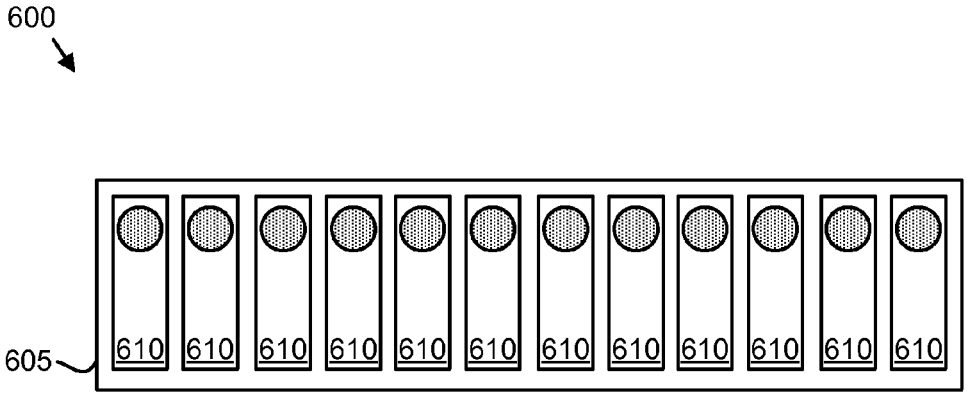
FIG. 6 is a schematic block diagram illustrating one embodiment of switches of the present invention with the same interface settings.

FIG. 6 is a schematic block diagram illustrating a switch 605. The switch 605 may embody the color selection interface. In one embodiment, the switch 605 comprises a plurality of binary switches 610. Some of the binary switches 610 may encode a group selection. Other binary switches 610 may encode the color identifying value.

For example, three binary switches 610 may encode one of eight group selections. Nine other binary switches 610 may encode the color selection value. In one embodiment, the color in nanometers of the color selection value is calculated using Equation 2, where spell $v_b$ is the color value and $v_{max}$ is the maximum binary value.

$$\text{Color}=(v_b/v_{max})*300+400 \qquad \text{Equation 2}$$

In addition to physical recognition of a group of devices, such a color and graphical display combination can be used to identify the association within a single group among a multitude of similar groups during remote queries using a handheld display. Infrared, Bluetooth, or other wireless communication can be used to gain insight into system event history and current status. Association between the queried device and the handheld device can be exacted by applying a similar tricolor LED and/or graphical wavelength display to both devices. In this case, the administrator can be sure that the handheld is communicating with the target device or group of devices.

The schematic flow chart diagram that follows is set forth as a logical flow chart diagram. As such, the depicted order and labeled steps are indicative of one embodiment of the presented method. Other steps and methods may be conceived that are equivalent in function, logic, or effect to one or more steps, or portions thereof, of the illustrated method. Additionally, the format and symbols employed are provided to explain the logical steps of the method and are understood not to limit the scope of the method. Although various arrow types and line types may be employed in the flow chart diagrams, they are understood not to limit the scope of the corresponding method. Indeed, some arrows or other connectors may be used to indicate only the logical flow of the method. For instance, an arrow may indicate a waiting or monitoring period of unspecified duration between enumerated steps of the depicted method. Additionally, the order in which a particular method occurs may or may not strictly adhere to the order of the corresponding steps shown.

Figure 7:
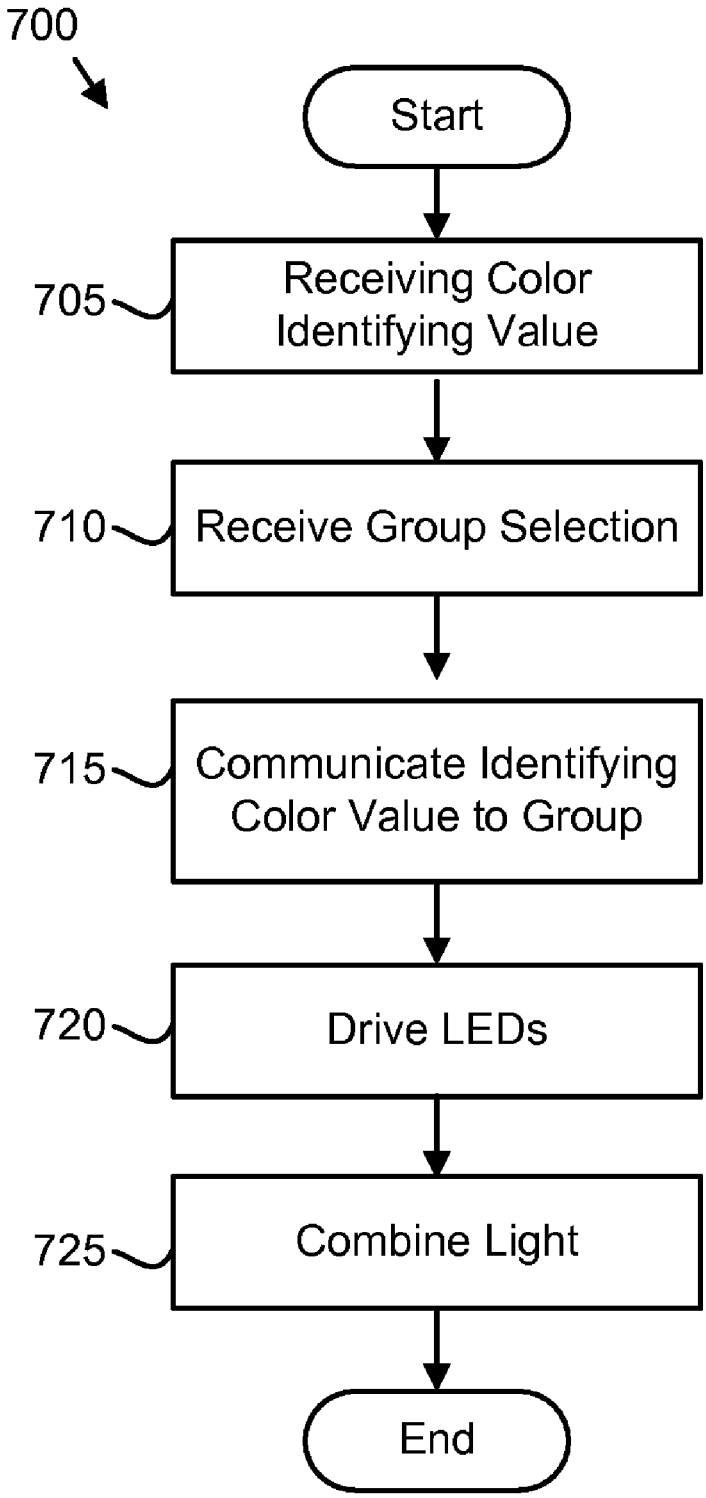
FIG. 7 is a schematic flow chart diagram illustrating one embodiment of a device group identification method of the present invention.

FIG. 7 is a schematic flow chart diagram illustrating one embodiment of a device group identification method 700 of the present invention. The device group identification method 700 substantially includes the steps to carry out the functions presented above with respect to the operation of the described apparatus and system of FIGS. 1-6. In one embodiment, the device group identification method 700 is implemented with a computer program product comprising a computer useable medium. The computer useable medium has a computer readable program which is stored on a tangible storage device. The computer readable program may be integrated into a computing system, such as the controller 215, wherein the program in combination with the computing system is capable of performing the device group identification method 700.

The device group identification method 700 for deploying computer infrastructure comprises integrating a computer readable program stored on a tangible storage device into a computing system. The program in combination with the computing system is capable of receiving a color identifying value and a group selection for a group of devices, communicating the color identifying value, driving the at least two LEDs, and combining the light emitted by the at least two LEDs into an identifying color.

The color selection interface 500 receives 705 the color identifying value. The color identifying value may specify a color in nanometers. Alternatively, the color identifying value may specify a numeric color value using a PANTONE MATCHING SYSTEM® color, a color wheel color, and the like.

In one embodiment, the administrator inputs the color identifying value in the color value field 520 of the GUI 505 executing on an element of the management network 225 such as a computer. For example, the administrator may enter the color identifying value at a computer console that manages a plurality of devices 105 including servers, storage devices, and the like in the data processing system 100. In an alternate embodiment, the administrator specifies the color identifying value in a configuration file stored on an element of the management network 225.

In addition, the color selection interface 500 receives 710 a group selection for the group of devices 105. The example, an administrator may input a number for a group of devices 105 in the group number field 525 of the GUI 505. Alternatively, the administrator may specify the number for the group of devices 105 in the configuration file.

In one embodiment, the color selection interface 500 communicates 715 the color identifying value over communication channel. The communication channel may be shared among the group of devices 105 through management network.

The controller 215 drives 720 the at least two LEDs 205 to each emit light at specified intensities in response to a color identifying value. Each LED 205 is configured to emit a wavelength of light that is different from a wavelength of each other LED 205.

The blending medium 210 combines 725 the light emitted by the at least two LEDs 205 into an identifying color that identifies a group of devices 105. The blending medium 210 may combine 725 the light as the light passes through the blending medium 210.

The controller 215 drives 720 the at least two LEDs 205 of each group identification device of the present invention to each emit light at specified intensities in response to the color identifying value. The at least two LEDs 205 emit a wavelength of light that is different from a wavelength of each other LED. A blending medium 210 combines the light emitted by the at least two LEDs 205 into an identifying color that identifies a group of devices 105.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An identification apparatus, the apparatus comprising:

a management network comprising a tangible storage device storing a computer readable program and a processor executing the computer readable program, the management module assigning a group selection to a logical group of a plurality of data processing devices disposed in a plurality of racks, each rack comprising at least two data processing devices, the management module further comprising a color selection interface that receives a color identifying value and the group selection and communicates the color identifying value to each data processing device in the logical group;

each data processing device comprising:

at least two light emitting diodes (LED), each LED emitting a wavelength of light that is different from a wavelength of each other LED;

a controller driving the at least two LEDs to each emit light at specified intensities in response to the color identifying value; and a blending medium combining the light emitted by the at least two LEDs into an identifying color that identifies the logical group.

2. The apparatus of claim 1, the apparatus comprising three LEDs.

3. The apparatus of claim 2, wherein a first LED emits a green wavelength, a second LED emits a blue wavelength, and a third LED emits a red wavelength.

4. The apparatus of claim 2, wherein a first LED emits a cyan wavelength, a second LED emits a magenta wavelength, and a third LED emits a green wavelength.

5. The apparatus of claim 2, wherein a first LED emits a violet wavelength, a second LED emits an orange wavelength, and a third LED emits a green wavelength.

6. The apparatus of claim 2, wherein the LEDs emit wavelengths selected from red, green, blue, cyan, magenta, purple, orange, red-orange, red-violet, yellow-orange, yellow-green, blue-violet, and blue-green.

7. The apparatus of claim 1, wherein the LEDs are selected from lensed LEDs and lensless LEDs.

8. The apparatus of claim 1, wherein the color selection interface is configured as a Graphical User Interface (GUI).

9. The apparatus of claim 1, wherein the color selection interface is configured as a switch.

10. The apparatus of claim 1, wherein the blending medium comprises a frosted shield.

11. The apparatus of claim 1, wherein the blending medium comprises a light pipe.

12. The apparatus of claim 1, the controller further receiving the color identifying value over a communication channel.

13. The apparatus of claim 12, wherein the communication channel is shared among the group of devices through the management network.

14. A computer program product comprising a computer useable medium having a computer readable program stored on a tangible storage device, wherein the computer readable program when executed on a computer causes the computer to:

assign a group selection to a logical group of a plurality of data processing devices disposed in a plurality of racks, each rack comprising at least two data processing devices;

receive from a color selection interface a color identifying value and the group selection;

communicate the color identifying value to each data processing device in the logical group;

drive at least two LEDs to each emit light at specified intensities in response to the color identifying value, wherein each LED emits a wavelength of light that is different from a wavelength of each other LED and a blending medium combines the light emitted by the at least two LEDs into an identifying color that identifies the logical group.

15. The computer program product of claim 14, the computer readable program further causing the computer to drive the LEDs by communicating the color identifying value to a controller over a communication channel.

16. The computer program product of claim 15, wherein the communication channel is shared among the logical group through a management network.

17. An identification system, the system comprising:

a management network comprising a color selection interface that receives a color identifying value and a group selection;

a plurality of data processing devices that communicate over the management network, the plurality of data processing devices organized into at least two logical groups, each logical group comprising at least one data processing device disposed in a plurality of racks, each rack comprising at least two data processing devices;

the management network communicating the color identifying value to each data processing device in each logical group;

each data processing device comprising:

at least two LEDs, each LED emitting a wavelength of light that is different from a wavelength of each other LED;

a controller driving the at least two LEDs to each emit light at specified intensities in response to a color identifying value received over the management network; and a blending medium combining the light emitted by the at least two LEDs into an identifying color that identifies a group of the at least two logical groups.

18. A method for deploying computer infrastructure, comprising integrating a computer readable program stored on a tangible storage device into a computing system, wherein the program executed by the computing system performs the following:

receiving a color identifying value through a color selection interface;

receiving through the color selection interface a group selection for a group of data processing devices disposed in a plurality of racks, each rack comprising at least two data processing devices;

communicating the color identifying value to each data processing device in the logical group;

for each data processing device:

driving at least two LEDs to each emit light at specified intensities in response to the color identifying value, each LED emitting a wavelength of light that is different from a wavelength of each other LED; and combining the light emitted by the at least two LEDs into an identifying color that identifies the logical group.

* * * * *